US010712689B2

(12) United States Patent
Nakamura

(10) Patent No.: US 10,712,689 B2
(45) Date of Patent: Jul. 14, 2020

(54) IMAGE FORMING APPARATUS

(71) Applicant: SHARP KABUSHIKI KAISHA, Sakai, Osaka (JP)

(72) Inventor: Ginga Nakamura, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/260,956

(22) Filed: Jan. 29, 2019

(65) Prior Publication Data

US 2019/0235418 A1 Aug. 1, 2019

(30) Foreign Application Priority Data

Jan. 31, 2018 (JP) ..... 2018-015114

(51) Int. Cl.
*G03G 15/16* (2006.01)
*B65H 5/38* (2006.01)
*G03G 15/20* (2006.01)

(52) U.S. Cl.
CPC ..... *G03G 15/16* (2013.01); *B65H 5/38* (2013.01); *G03G 15/167* (2013.01); *G03G 15/20* (2013.01); *G03G 2215/00544* (2013.01)

(58) Field of Classification Search
CPC ..... G03G 15/16; G03G 15/20; B65H 5/38
See application file for complete search history.

(56) References Cited

U.S. PATENT DOCUMENTS

2009/0022514 A1* 1/2009 Fujiwara ..... G03G 21/1633 399/121
2010/0003051 A1* 1/2010 Sekina ..... G03G 15/1615 399/121
2013/0108320 A1* 5/2013 Ju ..... G03G 15/0189 399/121

FOREIGN PATENT DOCUMENTS

JP 2002-229348 A 8/2002

* cited by examiner

*Primary Examiner* — Gregory H Curran
(74) *Attorney, Agent, or Firm* — ScienBiziP, P.C.

(57) ABSTRACT

When a first unit is disposed at a position at which a transfer member comes into contact with an image carrier, the first unit is urged in a first urging direction intersecting a movement direction of a second unit by a second urging member disposed between the first unit and the second unit being movable between a first attachment position with respect to an image forming apparatus body and a second attachment position different from the first attachment position.

6 Claims, 11 Drawing Sheets

IMAGE FORMING APPARATUS

BACKGROUND

1. Field

The present disclosure relates to an image forming apparatus including a transfer unit that transfers a toner image formed on an image carrier to a sheet. Specifically, the disclosure relates to an image forming apparatus that enables a transfer unit to be accurately and stably positioned and disposed with respect to an image carrier.

2. Description of the Related Art

An image forming apparatus including an image carrier includes a transfer unit including a transfer member which comes into contact with the image carrier and holds a sheet at a contact portion while the sheet is rotated and carried to transfer a toner image formed on the image carrier to the sheet. During a transfer operation, the transfer member comes into contact with the image carrier to rotate, or comes into contact with the image carrier to rotate with the sheet in between. When the sheet is jammed during the transfer operation, it is desired to remove the jammed sheet. Therefore, a configuration of a transfer unit is proposed in which the transfer unit is moved so that a transfer member is separated from an image carrier. For example, a transfer unit capable of rotating around an axis of a registration roller is disclosed in Japanese Unexamined Patent Application Publication No. 2002-229348.

The transfer unit described in Japanese Unexamined Patent Application Publication No. 2002-229348 includes a mechanism in which a spring urges a transfer roller (transfer member) against a photosensitive body and the transfer unit is rotated around an axis of the registration roller when a paper jam occurs, and thereby the transfer roller can be separated from the photosensitive body. A side of the transfer unit opposite to the registration roller is urged by an urging member having an urging force larger than an urging force of the transfer roller to the photosensitive body when the transfer unit abuts against a right door (moving member). A transfer entrance guide has a protrusion portion which abuts against a developing device, and thus the rotation of the transfer unit stops due to urging of the right door, the transfer unit is positioned, and the transfer roller abuts against the photosensitive body with a predetermined urging force.

In this case, the right door urges the urging member and therefore the side of the transfer unit opposite to the registration roller is urged to a photosensitive body side. There is a problem that an urging direction of the urging member is the same as a movement direction of the right door, so that an operability (operation of disposing and moving the transfer unit at a predetermined position) of the movement of the right door becomes worse due to a reaction force of the urging member. Furthermore, there is a problem that a size of the right door is increased to avoid the right door being deformed by the reaction force of the urging member.

It is desirable to provide an image forming apparatus in which, when a transfer unit is urged and disposed by an urging member at a predetermined position of the image forming apparatus, deterioration of an operability of a moving member can be suppressed by suppressing a reaction force acting on the moving member for urging the transfer unit, and the transfer unit can be reliably held at the predetermined position.

SUMMARY

According to an aspect of the disclosure, there is provided an image forming apparatus including an image carrier, the apparatus including: a first unit that includes a transfer member which is rotatable and abuts against the image carrier and a first urging member for urging the transfer member against the image carrier, and that is movable from a position at which the transfer member comes into contact with the image carrier to a position at which the transfer member is separated from the image carrier, in which, when the first unit is disposed at the position at which the transfer member comes into contact with the image carrier, the first unit is urged in a first urging direction intersecting a movement direction of a second unit by a second urging member disposed between the first unit and the second unit being movable between a first attachment position with respect to an image forming apparatus body and a second attachment position different from the first attachment position.

DESCRIPTION OF THE EMBODIMENTS

Embodiment 1

Hereinafter, an embodiment will be described.

Figure 1:
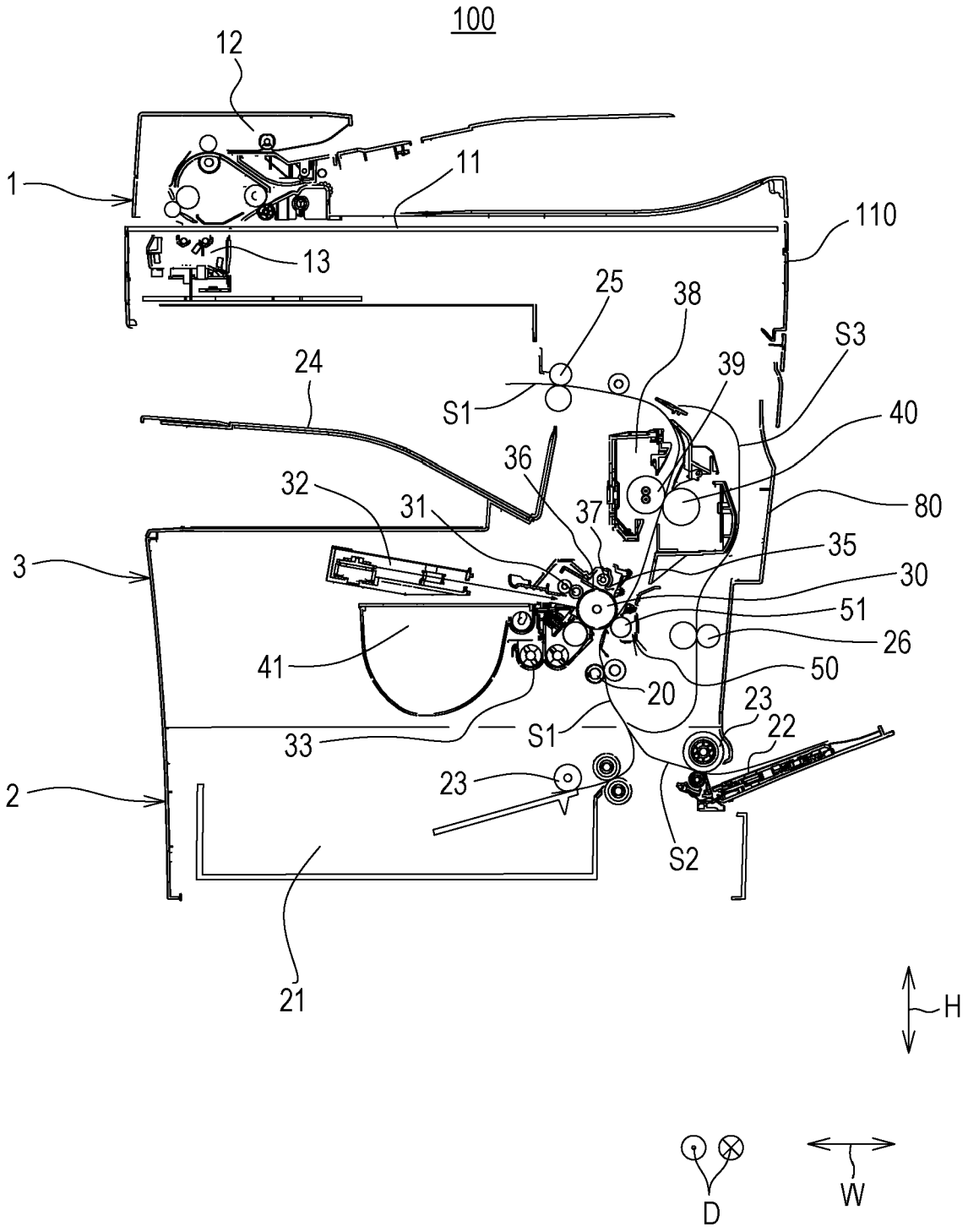
FIG. 1 is a schematic sectional view of an image forming apparatus according to Embodiment 1.

FIG. 1 is a schematic sectional view of an image forming apparatus 100 according to Embodiment 1.

The image forming apparatus 100 of the embodiment is an electrographic image forming apparatus and, as illustrated in FIG. 1, includes an image reading portion 1, an image forming portion 3 disposed below the image reading portion 1, and a sheet feeding portion 2 disposed below the image forming portion 3. Moreover, in the drawings, a reference sign W indicates an apparatus width (lateral) direction, a reference sign H indicates an apparatus height direction, and a reference sign D indicates an apparatus depth direction.

The image reading portion 1 includes a document placing table 11, an automatic document feeder 12 (ADF) for automatically supplying a document on the document placing table 11, and a document image reading unit 13 for scanning and reading an image of the document placed on the document placing table 11. The image forming portion 3 is provided in an image forming apparatus body 110. The image forming portion 3 is provided with a unit that performs an electrographic process with a photosensitive drum 30 (image carrier) as a center.

A charger 31, an optical scanning unit 32, a developing unit 33, a transfer unit 50, a cleaning device 35, and a static eliminating unit (not illustrated) are provided in a periphery of the photosensitive drum 30 in numerical order.

The charger 31 uniformly charges a surface of the photosensitive drum 30 to a predetermined potential. The optical scanning unit 32 scans an optical image on the uniformly charged photosensitive drum 30 to write an electrostatic latent image. The developing unit 33 attaches charged toner particles onto the electrostatic latent image written by the optical scanning unit 32 to visualize the electrostatic latent image. The developing unit 33 is provided with a toner container 41. The transfer unit 50 transfers a toner image visualized on the photosensitive drum 30 to a transfer sheet. The transfer unit 50 includes a transfer roller 51 (transfer member) that abuts against the photosensitive drum 30 and rotates together with the photosensitive drum 30. The cleaning device 35 removes a developer remaining on the photosensitive drum 30 with a cleaning blade 36, and thus a new image can be recorded on the photosensitive drum 30. Transfer residual toner removed from the photosensitive drum 30 by the cleaning blade 36 is carried in a vertical direction (upward) with respect to the drawing by a waste toner carrying screw 37, and is collected in a waste toner collection container (not illustrated) disposed between a front cabinet of the image forming apparatus and the image forming portion 3. The static eliminating unit is disposed between the cleaning device 35 and the charger 31. The static eliminating unit eliminates static electricity from the surface of the cleaned photosensitive drum 30 and uniformizes chargeability of the photosensitive drum 30 by the charger 31.

Furthermore, the image forming portion 3 includes a fixing unit 38 for melting the toner image transferred onto the transfer sheet by the transfer unit 50 and fixing the toner image on the sheet by pressure. The fixing unit 38 includes a heating roller 39 and a fixing roller 40.

The sheet feeding portion 2 includes a sheet cassette 21 and a manual sheet feeding tray 22 as a plurality of sheet feeding devices. The image forming apparatus 100 selects one of the sheet feeding devices from the sheet cassette 21 and the manual sheet feeding tray 22. Furthermore, the image forming apparatus 100 separates the transfer sheets one by one by a pickup roller 23 included in the corresponding selected sheet feeding device, and carries the transfer sheet so that a leading end of the transfer sheet bites into a nip portion of a registration roller 20. In this case, the registration roller 20 is stationary and, at an exact timing when a writing start position of the electrostatic latent image on the photosensitive drum 30 coincides with an image writing start position on the transfer sheet, the rotation of the registration roller 20 is started, so that the transfer sheet reaches the transfer roller 51 in the transfer unit 50.

The image forming apparatus 100 includes sheet carrying paths S1 and S2 for carrying the transfer sheet from the sheet feeding portion 2 to the image forming portion 3 and carrying the sheet on which the toner image is fixed to a sheet discharging tray 24, and a back-side printing sheet carrying path S3 for switch-back carrying of the transfer sheet during duplex printing. A sheet discharging roller 25 for discharging the sheet onto the sheet discharging tray 24 and a sheet carrying roller 26 are appropriately disposed in each of the carrying paths. Moreover, in the image forming apparatus 100, the transfer unit 50 is attached to a moving member 80 (for example, an opening/closing member, more specifically, an opening/closing door) together with a sheet guide portion forming a part of the back-side printing sheet carrying path S3. Therefore, when the moving member 80 is opened, the transfer unit 50 moves together with the moving member 80, and a path from the registration roller 20 to the fixing unit 38 in the sheet carrying path S1 is released. Accordingly, even if paper jam occurs, the sheet can be easily removed.

Next, an attachment structure of the transfer unit 50 to the image forming portion 3 according to Embodiment 1 will be described with reference to the drawings below.

Figure 2A:
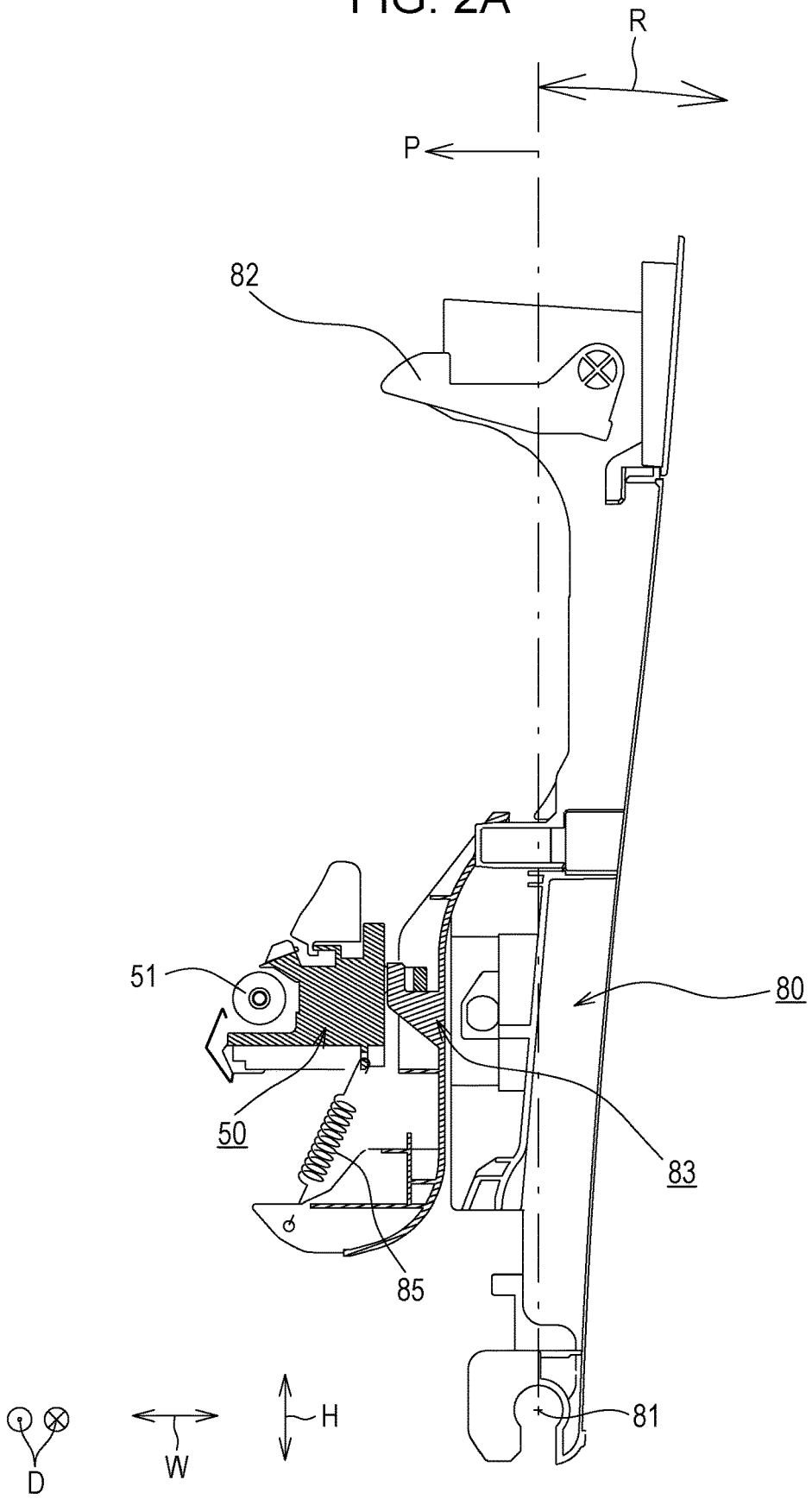
FIG. 2A is a sectional view illustrating a schematic attachment structure of a transfer unit according to Embodiment 1.

FIG. 2A is a sectional view illustrating a schematic attachment structure of the transfer unit 50 according to Embodiment 1.

As illustrated in FIG. 2A, the transfer unit 50 (first unit) including the transfer roller 51 is attached to a sheet guide portion 83 (second unit) that forms a part of the back-side printing sheet carrying path S3 using a second urging member 85. The sheet guide portion 83 is attached to the moving member 80 (second unit). The moving member 80 is the opening/closing door provided in the image forming apparatus body 110 rotatable in a direction of R in the drawing with a rotation axis 81 as a center. The moving member 80 is openable and closable with respect to the image forming apparatus body 110 by an operation of a lock member 82. As will be described in detail later, the moving member 80 rotates around the rotation axis 81, so that the moving member 80 can cause the transfer roller 51 (transfer unit 50) to be moved between a first position at which the transfer roller 51 abuts against the photosensitive drum 30 (see FIG. 1) and a second position at which the transfer roller 51 is separated from the photosensitive drum 30.

Figure 2B:
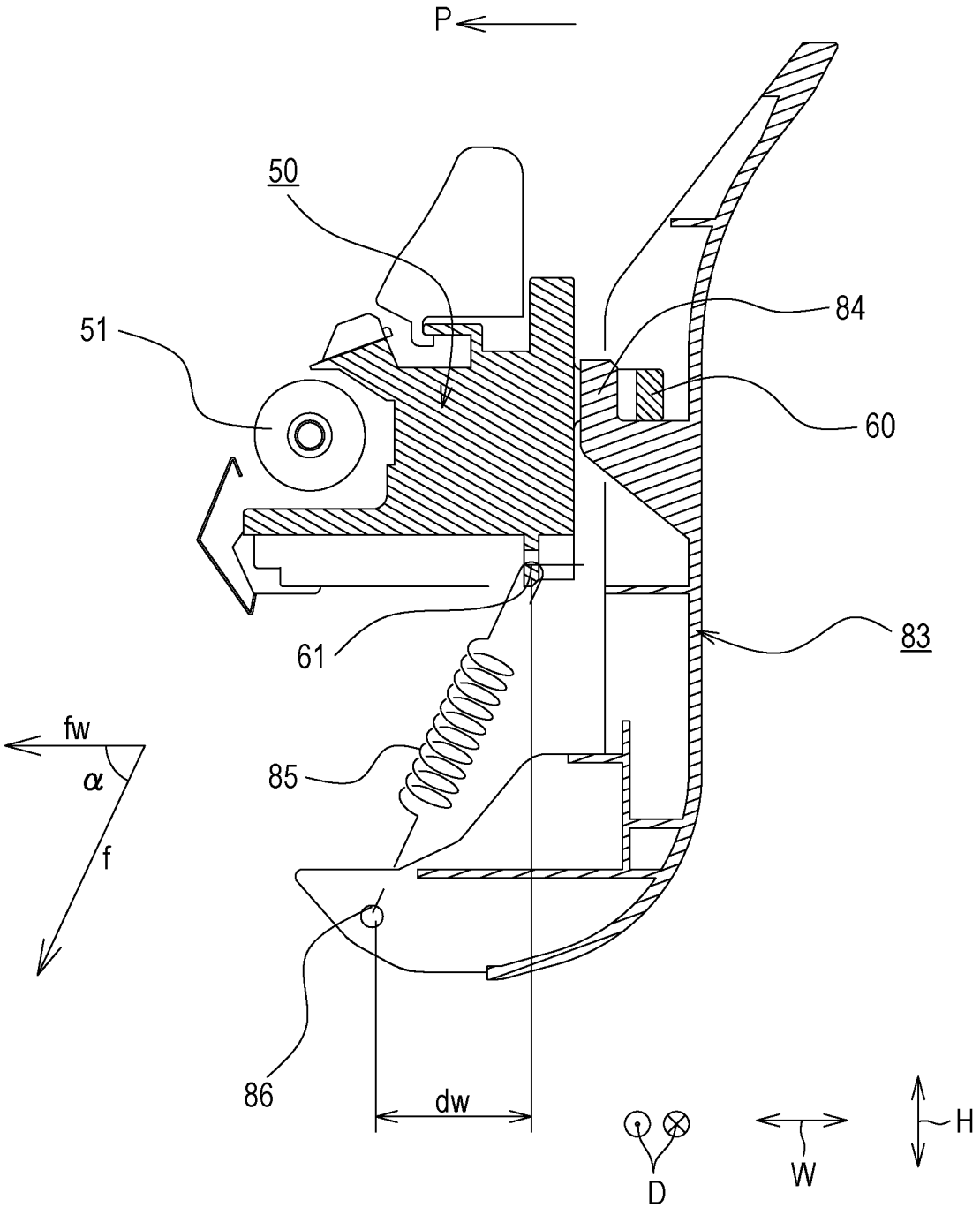
FIG. 2B is a sectional view illustrating a detailed attachment structure of the transfer unit.

FIG. 2B is a sectional view illustrating a detailed attachment structure of the transfer unit 50.

As illustrated in FIG. 2B, the transfer unit 50 includes a moving member engagement portion 60 engaging with a transfer unit engagement portion 84 of the sheet guide portion 83, and a second urging member locking portion 61 on one side connecting to one end portion of the second urging member 85. On the other hand, the sheet guide portion 83 includes the protrusion-like transfer unit engagement portion 84 engaging with the moving member engagement portion 60 in the transfer unit 50, and a second urging member locking portion 86 on the other side connecting to the other end portion of the second urging member 85. The transfer unit 50 is locked by the moving member engagement portion 60 engaging with the transfer unit engagement portion 84 in the sheet guide portion 83, and the second urging member 85 disposed between the second urging member locking portion 61 on the one side and the second urging member locking portion 86 on the other side provided in the sheet guide portion 83.

The second urging member 85 is disposed so as to intersect, by an angle of α, a rotation direction of the sheet guide portion 83, that is, a movement direction (P in FIG. 2B) of the moving member 80. Here, the movement direction P is the rotation direction of the moving member 80 in FIG. 2A, is a direction substantially perpendicular to a wall surface of the moving member 80, and indicates a movement direction of the transfer unit 50.

The second urging member locking portion 61 on the one side and the second urging member locking portion 86 on the other side are disposed apart from each other by a predetermined first distance dw in the movement direction P, and therefore an urging force f of the second urging member 85 acts in the direction indicated by an oblique downward arrow in FIG. 2B. Therefore, a component force fw acts on the second urging member locking portion 61 on the one side.

Next, a detailed structure and a detailed attachment structure of the transfer unit 50 of Embodiment 1 will be described.

Figure 3:
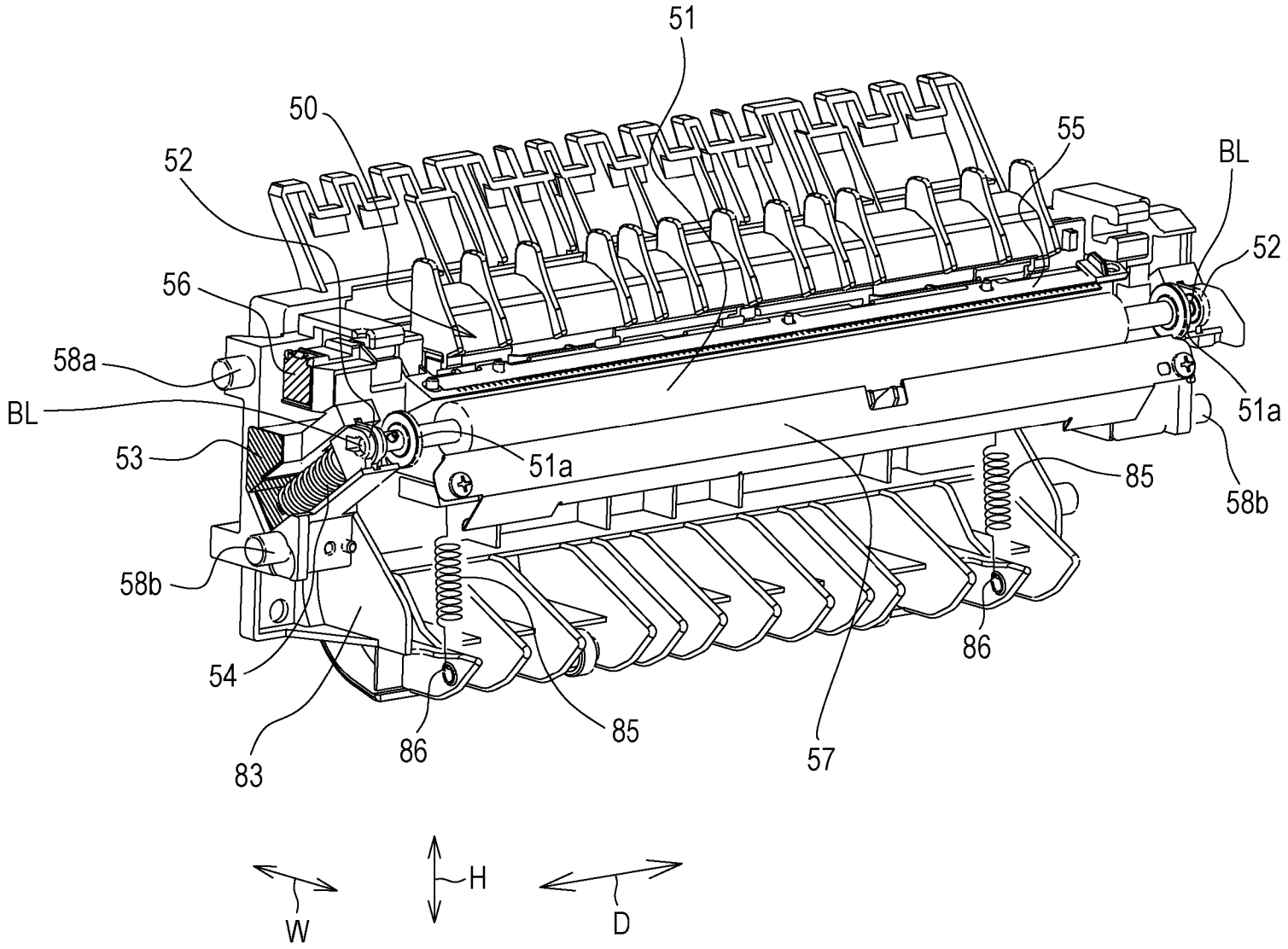
FIG. 3 is a perspective view of an attachment state of the transfer unit of Embodiment 1 as viewed from obliquely above a back side of an image forming portion.

FIG. 3 is a perspective view of an attachment state of the transfer unit 50 of Embodiment 1 as viewed from obliquely above a back side of the image forming portion 3.

The transfer unit 50 includes bearings BL and BL rotatably supporting the transfer roller 51. The bearings BL and BL are provided at both end portions in a longitudinal direction (apparatus depth direction D) of the transfer roller 51. The bearings BL and BL are supported by bearing support portions 52 and 52. The bearing support portions 52 and 52 are movably disposed, so that the transfer roller 51 supported by the bearing support portions 52 and 52 is urged by first urging members 54 and 54 against the photosensitive drum 30 (see FIG. 1). The bearings BL and BL, the bearing support portions 52 and 52, and the first urging members 54 and 54 are formed of conductive materials. The first urging member 54 on the back surface side is disposed so as to connect to a roller power supply terminal 53 (power supply terminal) of the transfer unit 50 disposed on the back surface side in the image forming portion 3. The roller power supply terminal 53 is engaged (electrically connected) with a body power supply terminal (not illustrated) disposed in the image forming portion 3, and is electrically connected to a bias power supply for the transfer roller 51 transferring a toner image to the transfer sheet.

The transfer unit 50 includes a peeling electrode 55 for peeling the transfer sheet from the photosensitive drum 30 (see FIG. 1). The peeling electrode 55 is provided on a downstream side of the transfer roller 51 in a sheet carrying direction. The peeling electrode 55 is connected to a peeling electrode power supply terminal (power supply terminal) 56 of the transfer unit 50, which is disposed on the back surface side in the image forming portion 3. The peeling electrode power supply terminal 56 is engaged (electrically connected) with the body power supply terminal (not illustrated) disposed in the image forming portion 3, and is electrically connected to the bias power supply for electrostatically attracting the transfer sheet.

A pair of protrusion portions 58*a* and 58*b* (guide protrusion portions) engaging with a transfer unit guide member 90 (see FIG. 5A described later) is disposed in each of the both end portions of the transfer unit 50 in the longitudinal direction (apparatus depth direction D). The pair of protrusion portions 58*a* and 58*b* is disposed to guide the transfer unit 50 to a predetermined position in the image forming portion 3.

The transfer unit 50 includes a sheet entry guide member 57 (sheet guide member). The sheet entry guide member 57 is provided on an upstream side of the transfer roller 51 in the sheet carrying direction. The transfer unit 50 is locked to the second urging member locking portions 86 and 86 on the other side in the sheet guide portion 83 using the second urging members 85 and 85. Moreover, the transfer roller 51 is an elastic roller in which a metallic shaft is coated with a conductive elastic body. Therefore, the transfer roller 51 includes collar members 51*a* and 51*a* for stably abutting against the photosensitive drum 30 (see FIG. 1). The collar members 51*a* and 51*a* are provided in both end portions of the shaft in the longitudinal direction (apparatus depth direction D).

Figure 4:
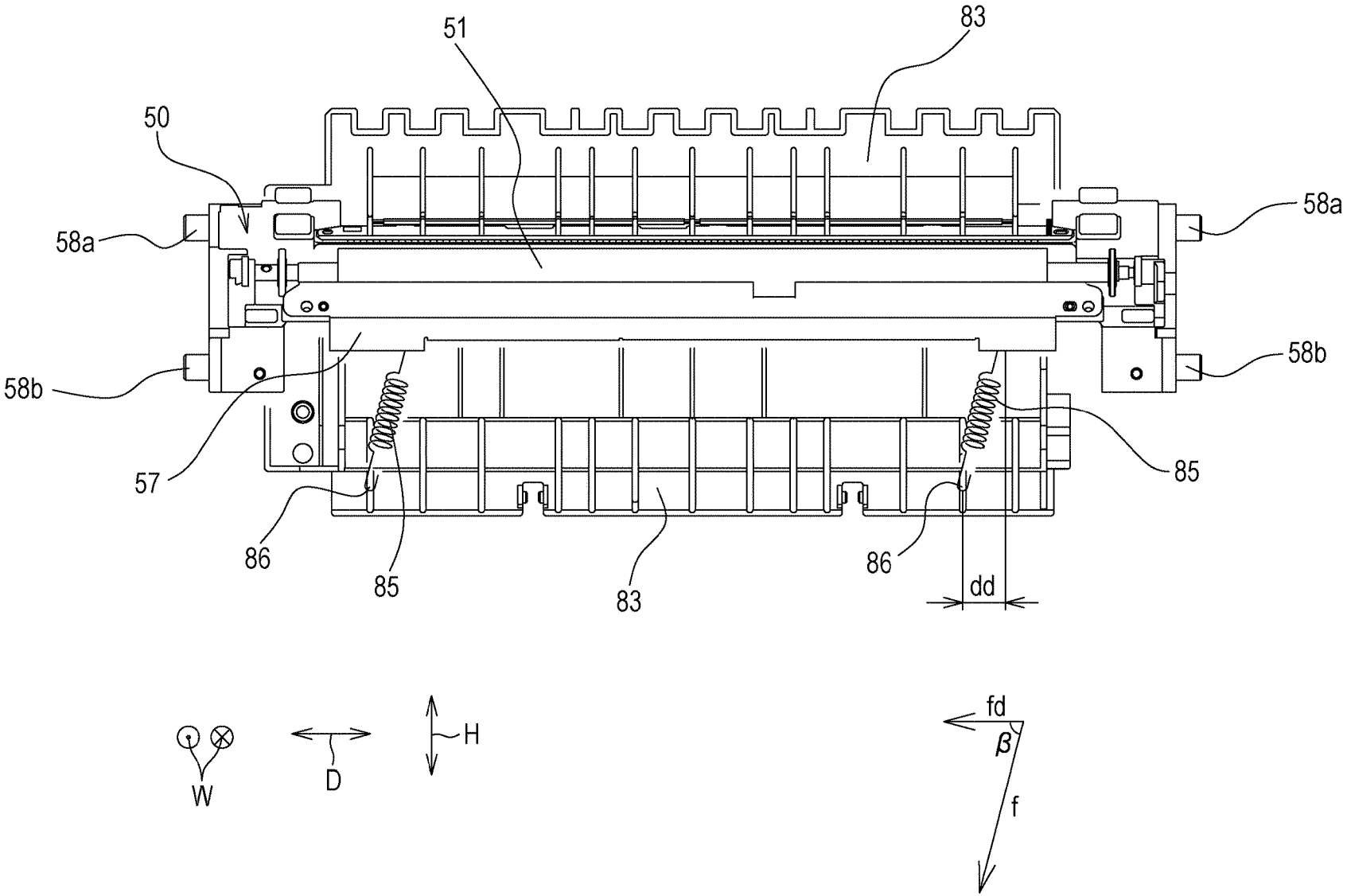
FIG. 4 is a side view of an attachment state of the transfer unit according to Embodiment 1 as viewed from an inside of the image forming portion.

FIG. 4 is a side view of an attachment state of the transfer unit 50 according to Embodiment 1 as viewed from an inside of the image forming portion 3. As illustrated in the drawing, the transfer unit 50 includes the pair of protrusion portions 58*a* and 58*b*. The pair of protrusion portions 58*a* and 58*b* is provided in each of the both end portions of the transfer unit 50 in the longitudinal direction (apparatus depth direction D).

The second urging members 85 and 85 are disposed with a predetermined angle β with respect to the longitudinal direction (apparatus depth direction D of the image forming portion 3) of the transfer unit 50. Specifically, the second urging member locking portions 61 and 61 (see FIG. 2B) on the one side in the transfer unit 50, and the second urging member locking portions 86 and 86 on the other side in the sheet guide portion 83 are disposed to be positioned apart from each other by a predetermined second distance dd in the apparatus depth direction D. Therefore, an urging force of each of the second urging members 85 and 85 acting on the transfer unit 50 has a component force fd. The component force fd acts toward the back surface side of the image forming portion 3 in the longitudinal direction of the transfer unit 50. Therefore, the roller power supply terminal 53 and the peeling electrode power supply terminal 56 are urged toward a body power supply terminal (not illustrated) on the image forming apparatus body 110 side, and are stably electrically connected to the body power supply terminal on the image forming apparatus body 110 side. Therefore, power can be stably supplied to the transfer roller 51 and the peeling electrode 55.

Next, a positioning structure of the transfer unit 50 to the image forming portion 3 will be described below with reference to FIGS. 5A, 5B, and 5C.

Figure 5A:
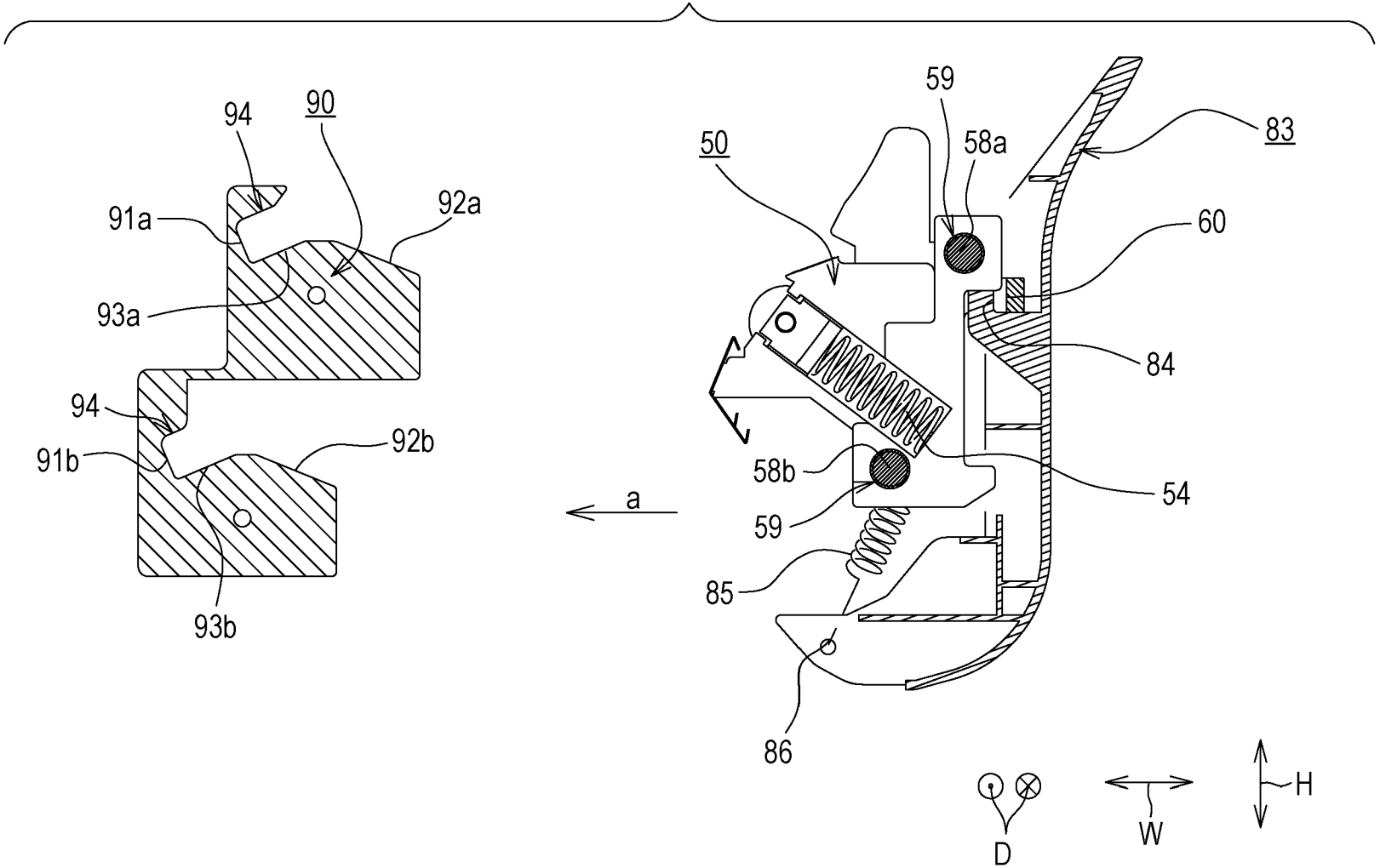
FIG. 5A is a sectional view illustrating an engagement portion included in the transfer unit and a body engagement portion included in an image forming apparatus body of Embodiment 1.

FIG. 5A is a sectional view illustrating engagement portions 59 and 59 included in the transfer unit 50 and body engagement portions 94 and 94 included in the image forming apparatus body 110 of Embodiment 1. FIG. 5B is a sectional view illustrating a state while the transfer unit 50 engages with the body engagement portions 94 and 94. FIG. 5C is a sectional view illustrating a state where the transfer unit 50 is engaged with the body engagement portions 94 and 94.

FIG. 5A illustrates a shape of the transfer unit guide member 90 (guide member, or unit positioning portion) disposed in the image forming portion 3 and a positional relationship of the pair of protrusion portions 58*a* and 58*b* engaging with the transfer unit guide member 90.

The transfer unit guide member 90 includes a pair of first inclined surface portions 92*a* and 92*b* (guide portions) for moving the pair of corresponding protrusion portions 58*a* and 58*b* of the transfer unit 50 in a first direction P1 (see FIG. 5B) for increasing the urging force of the second urging members 85 and 85. The transfer unit guide member 90 includes a pair of stopper portions 91*a* and 91*b* for locking the transfer unit 50 to a predetermined position, and a pair of second inclined surface portions 93*a* and 93*b* (guide portions) respectively facing the pair of stopper portions 91*a* and 91*b*. The pair of stopper portions 91*a* and 91*b* respectively lock the pair of protrusion portions 58*a* and 58*b* to predetermined locking positions. Moreover, the second inclined surface portion 93*a* on one side and the second inclined surface portion 93*b* on the other side are formed so that inclined surfaces thereof intersect an urging direction of the second urging members 85 and 85. The pair of second inclined surface portions 93*a* and 93*b* respectively intersect the pair of first inclined surface portions 92*a* and 92*b*.

Figure 5B:
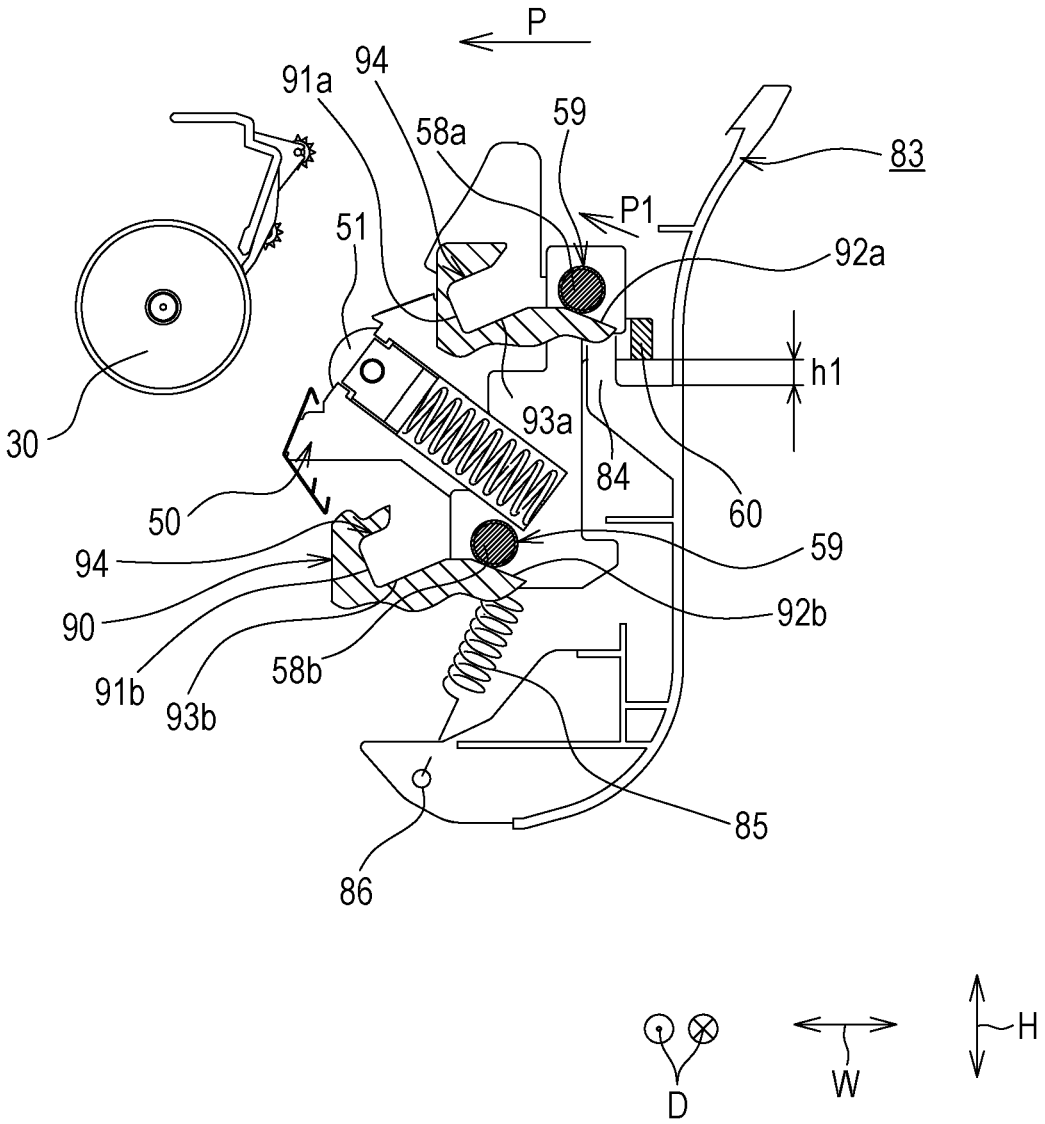
FIG. 5B is a sectional view illustrating a state while the transfer unit engages with the body engagement portion.

FIG. 5B illustrates a state where the transfer unit 50 approaches the photosensitive drum 30, and the protrusion portion 58*a* on one side and the protrusion portion 58*b* on the other side respectively run on the first inclined surface portion 92*a* on one side and the first inclined surface portion 92*b* on the other side in the transfer unit guide member 90. As illustrated in FIG. 5B, the transfer unit 50 is pushed up by the first inclined surface portion 92*a* and the first inclined surface portion 92*b* in the first direction P1 in FIG. 5B and moves so that the urging forces of the second urging members 85 and 85 increase. In this case, the position of the moving member engagement portion 60 of the transfer unit 50 moves from an engagement surface of the transfer unit engagement portion 84 of the sheet guide portion 83 to a position separated by a predetermined first distance h1.

Figure 5C:
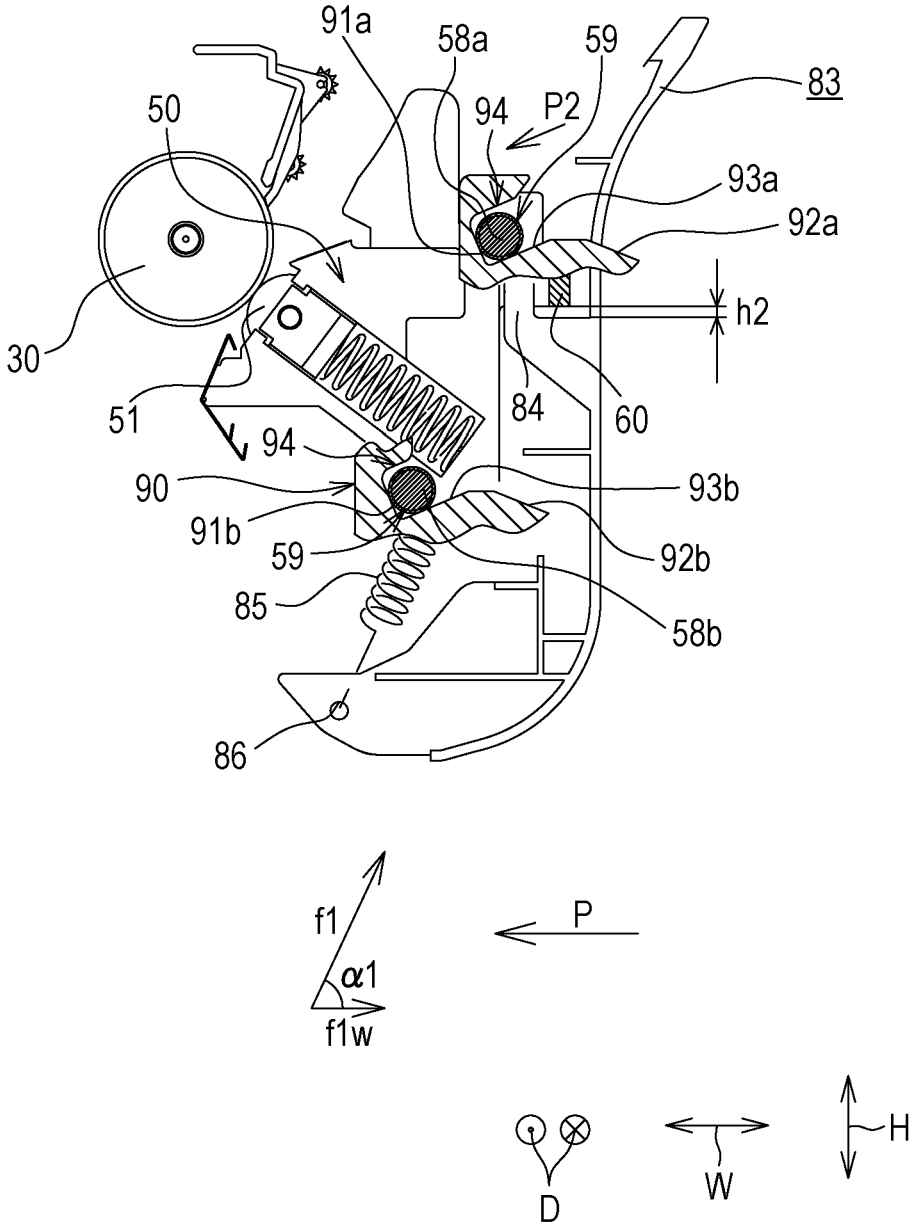
FIG. 5C is a sectional view illustrating a state where the transfer unit is engaged with the body engagement portion.

Furthermore, when the sheet guide portion 83 moves in a left direction (that is, the moving member 80 is on the photosensitive drum 30 side in the left direction), the protrusion portion 58*a* and the protrusion portion 58*b* move in a second direction P2 in FIG. 5C, respectively abut against the stopper portion 91*a* and the stopper portion 91*b*, and stop at positions being in contact with the second inclined surface portion 93*a* and the second inclined surface portion 93*b* to be fixed. In this case, the position of the moving member engagement portion 60 of the transfer unit 50 is located at a position separated from the engagement surface of the transfer unit engagement portion 84 of the sheet guide portion 83 by a predetermined second distance h2, and the transfer unit 50 is locked to the transfer unit guide member 90 in the image forming portion 3 by the urging forces of the second urging members 85 and 85. In this case, the second urging members 85 and 85 urge the transfer unit 50 to the image forming portion 3 at an angle of $\alpha$1 with respect to the movement direction P (rotation direction) of the sheet guide portion 83, with an urging force f1. In this case, the reaction force f1 of the second urging members 85 and 85 acting on the second urging member locking portions 86 on the other side in the sheet guide portion 83 has a component force f1*w* in the movement direction P (rotation direction) of the sheet guide portion 83. The component force f1*w* has a value smaller than that of the urging force (f1) of the second urging members 85 and 85, and thus it is less likely to hinder the moving operation of the sheet guide portion 83 or to deteriorate operability. Since the urging force (f1) of the transfer unit 50 (protrusion portion 58*a* and protrusion portion 58*b*) exerted on the transfer unit guide member 90 can be increased, the transfer unit 50 can be stably attached to the image forming portion 3 with high accuracy. Moreover, when the transfer unit 50 is not in contact with the transfer unit guide member 90, the moving member engagement portion 60 in the transfer unit 50 is in contact with the engagement surface of the transfer unit engagement portion 84 of the sheet guide portion 83 (see FIG. 5A). Therefore, in this case, the transfer unit 50 is locked to the sheet guide portion 83 with the urging force f smaller than the urging force (f1).

As described above, in the image forming apparatus 100 according to Embodiment 1, the second urging members 85 and 85 are provided so that the urging direction of the second urging members 85 and 85 urging the transfer unit 50 against the image forming portion 3 intersects the movement direction P (rotation direction) of the sheet guide portion 83 supporting the transfer unit 50, that is, the moving member 80 (opening/closing door portion included in the image forming portion 3) to which the sheet guide portion 83 is attached. Therefore, it is less likely to deteriorate the operability of the moving member 80, and it enables the transfer unit 50 to be locked to a predetermined position of the image forming portion 3. Since the component force f1*w* of the reaction force f of the moving member 80 among the reaction forces can be decreased when the transfer unit 50 is locked to the image forming portion 3, it is possible to effectively avoid the moving member 80 to be deflected and deformed by receiving the reaction force or the moving member 80 to be moved from a locking position by the reaction force. Furthermore, since the force applied to the moving member 80 is reduced, a size of the lock member 82 can be reduced. Furthermore, since the urging force f (locking force) when the transfer unit 50 is locked to the transfer unit guide member 90 can be increased, the transfer roller 51 can stably abut against the photosensitive drum 30 with a predetermined urging force by the first urging members 54 and 54.

The second urging members 85 and 85 are disposed so as to have the component force fd (see FIG. 4) in the longitudinal direction, that is, the apparatus depth direction D of the transfer unit 50. Therefore, the power supply terminals (53 and 56) of the transfer unit 50 disposed on the back surface side in the image forming portion 3 can stably come into contact with the body power supply terminal disposed on the body side in the image forming portion 3.

Embodiment 2

Next, an image forming apparatus 100 according to Embodiment 2 will be described below with reference to the drawings. Moreover, in Embodiment 2, a structure of the transfer unit is different from that of Embodiment 1, and the other structures are substantially similar to those of Embodiment 1.

Figure 6A:
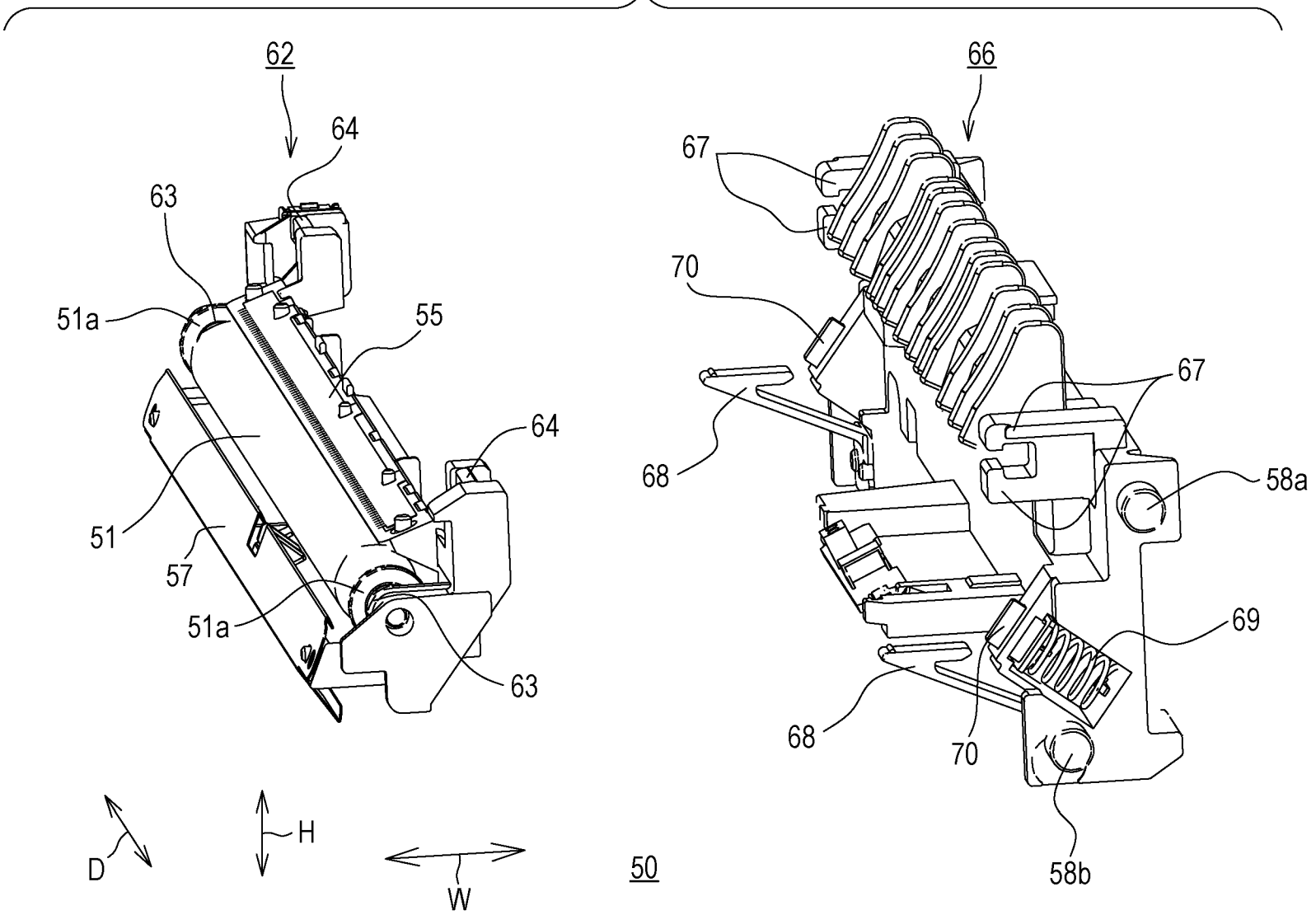
FIG. 6A is a perspective view illustrating a unit configuration of a transfer unit according to Embodiment 2.
Figure 6B:
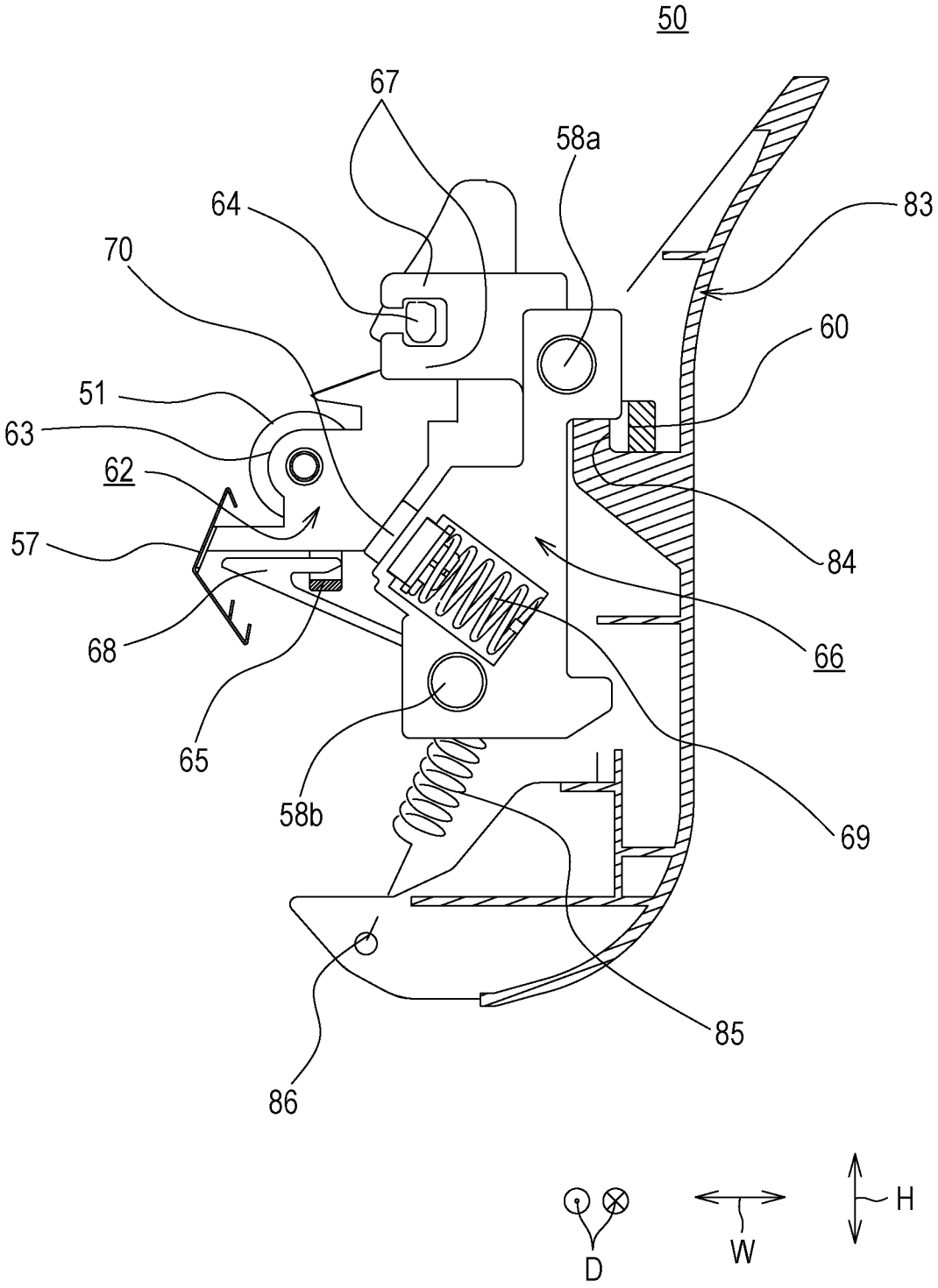
FIG. 6B is a sectional view illustrating a detailed attachment structure of the transfer unit of Embodiment 2.

FIG. 6A is a perspective view illustrating a unit configuration of a transfer unit 50 according to Embodiment 2. FIG. 6B is a sectional view illustrating a detained attachment structure of the transfer unit 50 of Embodiment 2.

In Embodiment 2, the transfer unit 50 includes a roller holder 62 (third unit) including a transfer roller 51, a peeling electrode 55, and a sheet entry guide member 57, and an urging unit 66 holding the roller holder 62.

The urging unit 66 includes a pair of roller holder guide engagement portions (67 and 68) and (67 and 68) engaging with the roller holder 62, holder urging members 69 and 69 (first urging members) urging the roller holder 62 against the photosensitive drum 30, and contact holding covers 70 and 70 (holder urging member covers) transmitting the urging forces of the holder urging members 69 and 69 to the roller holder 62.

The roller holder 62 includes a pair of engagement portions 64 and 65 (see FIG. 6B) engaging with the urging unit 66, and a roller holder positioning portion 63 engaging with a positioning portion of a photosensitive unit having the photosensitive drum 30 (see FIG. 1).

Similar to the transfer unit 50 of Embodiment 1, the urging unit 66 includes a pair of protrusion portions 58*a* and 58*b* engaging with the transfer unit guide member 90.

Next, an engagement state between the roller holder 62 and the urging unit 66 will be described with reference to FIG. 6B.

The urging unit 66 is locked to the sheet guide portion 83 (second unit) using the second urging members 85 and 85. A locking method and locking positions of the second urging members 85 and 85, an urging direction of the second urging members 85 and 85, and the like are the same as those of the transfer unit 50 of Embodiment 1.

The roller holder 62 is formed such that the engagement portion 64 on one side engages with the roller holder guide engagement portion 67 on one side in the urging unit 66, and the engagement portion 65 on the other side engages with the roller holder guide engagement portion 68 on the other side in the urging unit 66. The roller holder 62 is urged toward the photosensitive drum 30 (see FIG. 1) by the holder urging members 69 and 69 via the contact holding covers 70. The roller holder 62 is formed such that the roller holder positioning portions 63 and 63 provided in both end portions thereof in the longitudinal direction (apparatus depth direction D) engage with the positioning portion of the photosensitive unit having the photosensitive drum 30. Therefore, the transfer roller 51 can be disposed at a predetermined position. Moreover, similar to Embodiment 1, collar members 51*a* and 51*a* for regulating the position of the transfer roller 51 abutting against the photosensitive drum are disposed in the transfer roller 51.

In Embodiment 2, the roller holder 62 including the roller holder positioning portion 63 engaging with the positioning portion provided in the photosensitive unit at an end portion is urged against the photosensitive drum 30 by the holder urging member 69 included in the urging unit 66. Therefore, the transfer roller 51 can be disposed at a predetermined position with respect to the photosensitive drum 30 with high accuracy. Furthermore, the sheet entry guide member 57 and the peeling electrode 55 are disposed in the roller holder 62 so as to have a predetermined positional relationship with the transfer roller 51. Therefore, the sheet entry guide member 57 and the peeling electrode 55 can be also disposed so as to have a predetermined positional relationship with the photosensitive drum 30 with high accuracy.

Figure 7:
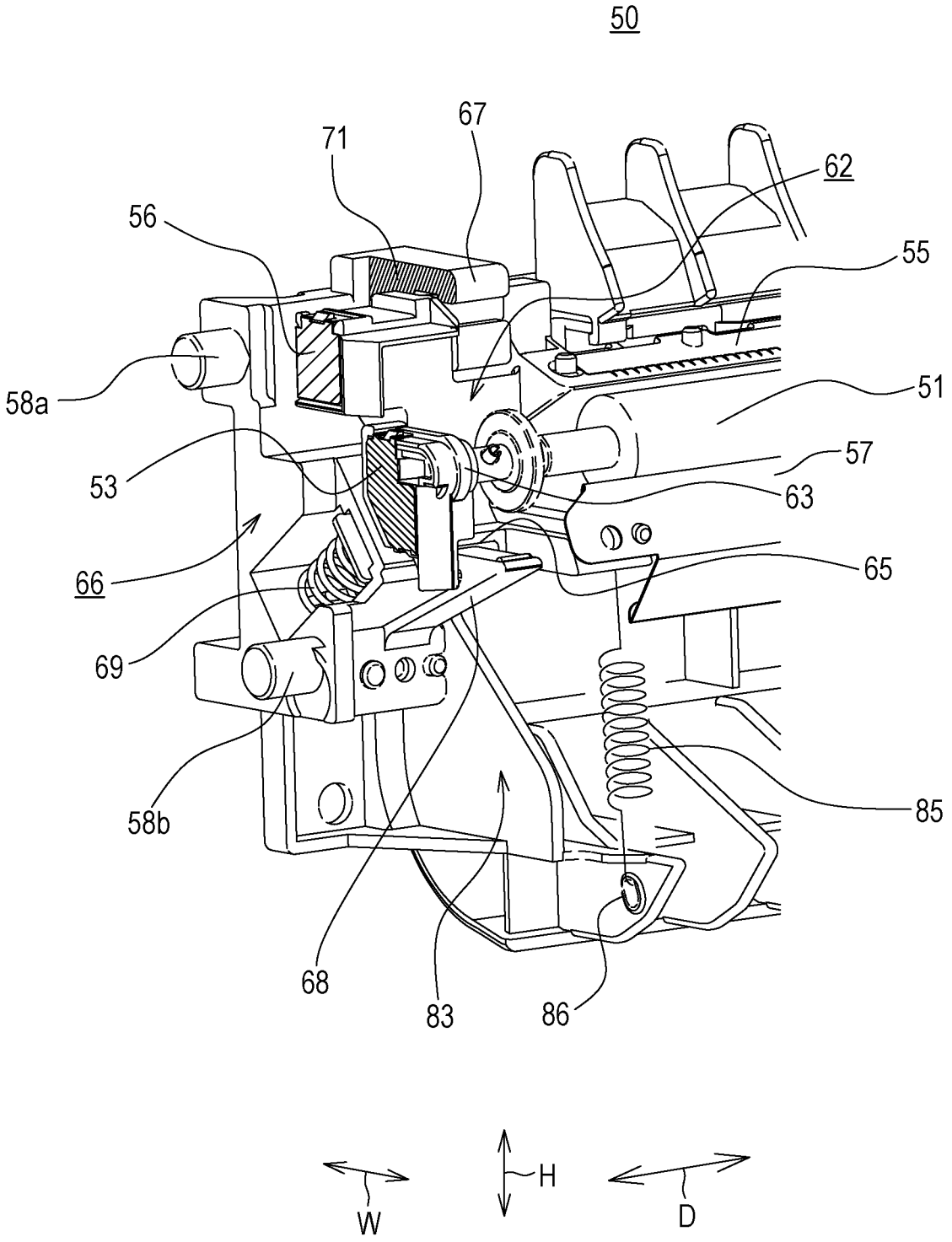
FIG. 7 is an enlarged perspective view of the vicinity of power supply terminals in the transfer unit of Embodiment 2 as viewed from a back surface side of an image forming portion.

FIG. 7 is an enlarged perspective view of power supply terminals (53 and 56) in the transfer unit 50 of Embodiment 2 as viewed from a back surface side of an image forming portion 3.

As illustrated in FIG. 7, in the transfer unit 50 of Embodiment 2, the roller power supply terminal 53 and the peeling electrode power supply terminal 56 are included in the roller holder 62.

Similar to Embodiment 1, the power supply terminals (53 and 56) are urged against the back surface side of the image forming portion 3 by the second urging members 85 and 85. Therefore, the power supply terminals (53 and 56) can stably come into contact with the body power supply terminal disposed on the back surface side of the image forming portion 3. Therefore, it is possible to stably supply power to the transfer roller 51 and the peeling electrode 55. Moreover, a roller holder stopper portion 71 (regulating portion) is provided in a side surface portion of one of the roller holder guide engagement portions 67 on the one side in the urging unit 66. When the power supply terminals (53 and 56) come into contact with the body power supply terminal, the roller holder stopper portion 71 regulates a position in the longitudinal direction (apparatus depth direction D), so that the roller holder 62 does not move in the longitudinal direction (apparatus depth direction D).

As described above, in the image forming apparatus 100 according to Embodiment 2, the transfer unit 50 can be formed such that the roller holder 62 including the transfer roller 51, the sheet entry guide member 57, and the peeling electrode 55, and the urging unit 66 for urging the roller holder 62 can be separately constituted. Therefore, the transfer roller 51, the sheet entry guide member 57, and the peeling electrode 55 are disposed with high accuracy in a predetermined positional relationship.

The power supply terminals (53 and 56) for respectively supplying power to the transfer roller 51 and the peeling electrode 55 are disposed in the roller holder 62, and the roller holder stopper portion 71 is provided in the urging unit 66. Therefore, it is possible to reliably supply power to the transfer roller 51 and the peeling electrode 55.

The embodiments disclosed this time are examples in all respects and are not a basis for a limited interpretation. Therefore, the technical scope of the disclosure is not interpreted only by the above-described embodiments but is defined based on the description of the claims. Also, meanings equivalent to claims and all changes within the scope are included.

The present disclosure contains subject matter related to that disclosed in Japanese Priority Patent Application JP 2018-015114 filed in the Japan Patent Office on Jan. 31, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus including an image carrier, comprising:

a first unit that includes a transfer member which is rotatable and abuts against the image carrier and a first urging member for urging the transfer member against the image carrier, and that is movable from a position at which the transfer member comes into contact with the image carrier to a position at which the transfer member is separated from the image carrier, wherein, when the first unit is disposed at the position at which the transfer member comes into contact with the image carrier, the first unit is urged in a first urging direction intersecting a movement direction of a second unit by a second urging member disposed between the first unit and the second unit being movable between a first attachment position with respect to an image forming apparatus body and a second attachment position different from the first attachment position, wherein the first unit includes a power supply terminal which is engaged with a body power supply terminal provided in the image forming apparatus body and supplies power to the transfer member, at an end surface of a portion of the first unit in a longitudinal direction, and wherein the second urging member is disposed to urge the first unit in a second urging direction along the longitudinal direction of the first unit, so that the power supply terminal is urged toward the body power supply terminal.

2. The image forming apparatus according to claim 1, wherein the first unit is locked to the second unit using the second urging member.

3. The image forming apparatus according to claim 1, wherein the first unit includes a sheet guide member for guiding a sheet, a peeling electrode for peeling the sheet having passed through the transfer member from the image carrier, and the power supply terminal for supplying power to the peeling electrode.

4. The image forming apparatus according to claim 3, wherein the first unit includes an urging unit and a third unit, and the urging unit movably supports the third unit toward the image carrier, the urging unit including the first urging member, the third unit including the transfer member, the peeling electrode, the sheet guide member, the power supply terminal for supplying power to the transfer member, and the power supply terminal for supplying power to the peeling electrode, wherein the first urging member is disposed to urge the third unit toward the image carrier, and wherein the urging unit includes a regulating portion that regulates a movement of the third unit in a direction in which the power supply terminals are separated from the body power supply terminal.

5. The image forming apparatus according to claim 1, wherein the first unit includes a guide protrusion portion that engages with a guide member disposed in the image forming apparatus body, and wherein the guide member includes a guide portion that guides the guide protrusion portion to a predetermined position, and the guide portion includes a first inclined surface portion, which guides the first unit to a position at which an urging force of the second urging member increases, on an insertion portion side of the guide protrusion portion.

6. The image forming apparatus according to claim 5, wherein the guide member includes a stopper portion that regulates a movement of the guide protrusion portion moving the guide portion and locks the guide protrusion portion at a predetermined position, and the guide portion includes a second inclined surface portion in a direction intersecting the first inclined surface portion over a predetermined distance from a position of the stopper portion.

* * * * *